US007980419B2

(12) United States Patent
Young et al.

(10) Patent No.: US 7,980,419 B2
(45) Date of Patent: Jul. 19, 2011

(54) DEVICE FOR DISPENSING CAPS USEFUL IN SYSTEM AND METHOD FOR DISPENSING PRESCRIPTIONS

(75) Inventors: Demetris P. Young, Durham, NC (US); George Raymond Abrams, Jr., Cary, NC (US); Joseph C. Moran, Jr., Durham, NC (US); Jeffrey P. Williams, Hillsborough, NC (US)

(73) Assignee: Parata Systems, L.L.C., Durham, NC (US)

( * ) Notice: Subject to any disclaimer, the term of this patent is extended or adjusted under 35 U.S.C. 154(b) by 1046 days.

(21) Appl. No.: 11/693,929

(22) Filed: Mar. 30, 2007

(65) Prior Publication Data

US 2008/0169302 A1 Jul. 17, 2008

(51) Int. Cl.

| | |
|---|---|
| ***B23Q 7/12*** | (2006.01) |
| ***B65H 9/00*** | (2006.01) |
| ***B65H 3/16*** | (2006.01) |
| ***B65H 3/00*** | (2006.01) |

(52) U.S. Cl. ..... 221/167; 221/227; 221/237; 221/166; 221/156; 221/76; 221/69; 221/13; 221/212; 221/265

(58) Field of Classification Search ..... 221/167, 221/277, 237, 166, 156, 76, 69, 13, 212, 221/265

See application file for complete search history.

(56) References Cited

U.S. PATENT DOCUMENTS

| | | | | |
|---|---|---|---|---|
| 2,601,570 | A * | 6/1952 | Suthers | 221/212 |
| 2,665,775 | A | 1/1954 | Smith | |
| 2,708,996 | A | 5/1955 | Skillman | |
| 2,748,914 | A * | 6/1956 | Day | 193/47 |
| 2,865,532 | A | 12/1958 | Smith | |
| 3,023,851 | A | 3/1962 | Stiller | |
| 3,144,958 | A | 8/1964 | Gumpertz | |
| 3,160,793 | A | 12/1964 | Colburn | |
| 3,179,288 | A | 4/1965 | Davy | |
| 3,185,851 | A | 5/1965 | D'Emilio | |

(Continued)

FOREIGN PATENT DOCUMENTS

| | | |
|---|---|---|
| CA | 936 501 | 11/1973 |

(Continued)

OTHER PUBLICATIONS

International Search Report and Written Opinion for PCT/US2008/000031, dated May 15, 2008.

*Primary Examiner* — Gene O. Crawford
*Assistant Examiner* — Rakesh Kumar
(74) *Attorney, Agent, or Firm* — Myers Bigel Sibley & Sajovec

(57) ABSTRACT

A device for singulating open-ended caps includes: a housing configured to retain a plurality of open-ended caps, the housing having an open lower end; an outer ring positioned below the housing; a drum fixed to and positioned within the outer ring to form a drum assembly, the drum including a hub having a substantially circular wall and a platform that extends radially outwardly from the wall to contact the outer ring, the hub and outer ring forming a circular gap therebetween, the platform being positioned below much of the gap and including a discontinuity; a mounting structure with an exit aperture fixed relative to the housing; and a rotary drive unit mounted to the drum that rotates the drum assembly about an axis of rotation.

12 Claims, 18 Drawing Sheets

U.S. PATENT DOCUMENTS

| | | | | | |
|---|---|---|---|---|---|
| 3,196,276 | A | | 7/1965 | Naab | |
| 3,206,062 | A | | 9/1965 | Rappaport | |
| 3,310,199 | A | | 3/1967 | Roberts | |
| 3,312,372 | A | | 4/1967 | Cooper, Jr. | |
| 3,410,450 | A | | 11/1968 | Fortenberry | |
| 3,417,542 | A | | 12/1968 | Merrill | |
| 3,436,736 | A | | 4/1969 | Platt | |
| 3,556,287 | A | * | 1/1971 | Bryner et al. | 198/633 |
| 3,556,342 | A | | 1/1971 | Guarr | |
| 3,599,152 | A | | 8/1971 | Williams | |
| 3,653,176 | A | | 4/1972 | Gess | |
| 3,730,388 | A | | 5/1973 | Bender | |
| 3,732,544 | A | | 5/1973 | Obland | |
| 3,780,907 | A | | 12/1973 | Colburn | |
| 3,815,780 | A | | 6/1974 | Bauer | |
| 3,837,139 | A | * | 9/1974 | Roseberg | 53/501 |
| 3,885,702 | A | | 5/1975 | Joslin | |
| 3,917,045 | A | | 11/1975 | Williams | |
| 3,921,851 | A | * | 11/1975 | Nilson | 221/151 |
| 4,024,984 | A | * | 5/1977 | Gyimothy et al. | 221/203 |
| 4,228,920 | A | * | 10/1980 | Burton | 221/265 |
| 4,267,942 | A | | 5/1981 | Wick | |
| 4,434,602 | A | | 3/1984 | Culpepper | |
| 4,546,901 | A | | 10/1985 | Buttarazzi | |
| 4,573,606 | A | | 3/1986 | Lewis | |
| 4,655,026 | A | | 4/1987 | Wigoda | |
| 4,664,289 | A | | 5/1987 | Shimizu | |
| 4,674,259 | A | | 6/1987 | Hills | |
| 4,674,651 | A | | 6/1987 | Scidmore | |
| 4,693,057 | A | | 9/1987 | Rittinger | |
| 4,695,954 | A | * | 9/1987 | Rose et al. | 221/15 |
| 4,741,428 | A | | 5/1988 | Taniguchi et al. | |
| 4,766,542 | A | | 8/1988 | Pilarczyk | |
| 4,767,023 | A | | 8/1988 | Hackmann | |
| 4,801,044 | A | | 1/1989 | Kubota et al. | |
| 4,805,377 | A | | 2/1989 | Carter | |
| 4,869,392 | A | | 9/1989 | Moulding, Jr. | |
| 4,918,604 | A | | 4/1990 | Baum | |
| 4,971,513 | A | | 11/1990 | Bergerioux | |
| 4,980,292 | A | | 12/1990 | Elbert | |
| 4,984,709 | A | | 1/1991 | Weinstein | |
| 5,018,644 | A | | 5/1991 | Hackmann | |
| 5,047,948 | A | | 9/1991 | Turner | |
| RE37,829 | E | | 9/2002 | Charhut | |
| 6,631,826 | B2 | | 10/2003 | Pollard et al. | |
| 6,971,541 | B2 | * | 12/2005 | Williams et al. | 221/13 |
| 6,971,544 | B2 | * | 12/2005 | Williams et al. | 221/167 |
| 7,014,064 | B2 | * | 3/2006 | Asada | 221/277 |
| 7,565,784 | B2 | * | 7/2009 | Williams et al. | 53/300 |
| 7,581,658 | B2 | * | 9/2009 | Mosconi et al. | 221/161 |

FOREIGN PATENT DOCUMENTS

| | | | |
|---|---|---|---|
| DE | 1481166 | | 8/1970 |
| GB | 1 168 758 | | 10/1969 |
| GB | 1 411 951 | | 10/1975 |
| JP | 51-000792 | B | 1/1976 |
| JP | 52-047400 | | 4/1977 |
| JP | 61-104904 | A | 5/1986 |
| JP | 63-208410 | A | 8/1988 |
| JP | 64-028102 | A | 1/1989 |
| JP | 1-288265 | A | 11/1989 |
| JP | 2-028417 | A | 1/1990 |

* cited by examiner

DEVICE FOR DISPENSING CAPS USEFUL IN SYSTEM AND METHOD FOR DISPENSING PRESCRIPTIONS

FIELD OF THE INVENTION

The present invention is directed generally to the dispensing of prescriptions of pharmaceuticals, and more specifically is directed to the automated dispensing of caps for pharmaceutical vials.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,544 to Williams et al. (hereinafter Williams '541). This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing certain of the operations may be improved. For example, the device that dispenses caps includes a hopper with a circumferential groove at its lower end that surrounds a rotatable central circular drum. The groove has a depth that is approximately the diameter of a closure and a width that is approximately the width of the closure. A circumferential rim juts radially inwardly from the wall of the hopper above the groove and drum. The sizes and configurations of the groove, drum and protrusion are such that a closure (which is a relatively flat, open-ended cylinder) can enter the groove from above only when the closure is oriented so that the open end of the closure faces the drum. This occurs because the open end of the closure can receive an arcuate portion of the edge of the drum, thereby allowing the closure to be positioned slightly farther from the wall (and, therefore, able to slide into the groove) than a closure oriented with the closed end facing the drum, which cannot pass between the drum and the rim in this manner. The floor of the hopper has an opening through which closures, once in the groove, can pass one at a time to a capping station.

Closures are dispensed by filling the bin with closures and rotating the drum. As the drum rotates, each closure tumbles until it eventually reaches the desired orientation and slides into the groove. As the drum continues to rotate, the closure eventually reaches the opening, at which point it passes through the opening and can pass to the capping station.

Each of the closure dispensers shown in the Williams '541 patent is limited to only a single size of closure. It may be desirable to be able to adjust the closure dispenser rapidly to adapt to different sizes of closures. As such, it may be desirable for the dispenser to take a configuration that enables such rapid adjustment. It also may be desirable to provide a system that can adapt to different sizes of closures without changing the configurations of multiple components of the system.

SUMMARY OF THE INVENTION

As a first aspect, embodiments of the present invention are directed to a device for singulating open-ended caps. The device comprises: a housing configured to retain a plurality of open-ended caps, the housing having an open lower end; an outer ring positioned below the housing; a drum fixed to and positioned within the outer ring to form a drum assembly, the drum including a hub having a substantially circular wall and a platform that extends radially outwardly from the wall to contact the outer ring, the hub and outer ring forming a circular gap therebetween, the platform being positioned below much of the gap and including a discontinuity; a mounting structure with an exit aperture fixed relative to the housing; and a rotary drive unit mounted to the drum that rotates the drum assembly about an axis of rotation. This configuration can carry out the cap singulation operation described above for the Williams '541 patent.

As a second aspect, embodiments of the present invention are directed to a device for singulating open-ended caps, the device comprising: a housing configured to retain a plurality of open-ended caps, the housing having an open lower end; an outer ring positioned below the housing; a drum fixed to and positioned within the outer ring to form a drum assembly, the drum including a hub having a substantially circular wall and a platform that extends radially outwardly from the wall to contact the outer ring, the hub and outer ring forming a circular gap therebetween, the platform being positioned below much of the gap and including a discontinuity; a mounting structure with an exit aperture fixed relative to the housing; and a rotary drive unit mounted to the drum that rotates the drum assembly about an axis of rotation. The outer ring includes first and second mating structures. The first mating structure is positioned on the outer ring above the second mating structure. The first mating structure is positioned to mate with mating structure of a drum having a platform located a first distance from the lowermost edge of the hub wall, and the second mating structure is positioned to mate with mating structure of a drum having a platform located a second distance from the lowermost edge of the hub wall.

As a third aspect, embodiments of the present invention are directed to a method of singulating open-ended caps, comprising tie steps of: (a) providing a drum assembly comprising an outer ring positioned below the housing and a drum fixed to and positioned within the outer ring, the drum including a hub having a substantially circular wall and a platform that extends radially outwardly from the wall to contact the outer ring, the hub and outer ring forming a circular gap therebetween, the platform being positioned below much of the gap and including a discontinuity; (b) feeding the drum assembly with caps; and rotating the drum assembly about an axis of rotation such that a cap drops into the gap and is conveyed to the discontinuity, from where the singulated cap exits the drum assembly. In some embodiments, a pre-staging platform receives the cap from the discontinuity and "pre-stages" it for the next instance in which a cap is required.

DETAILED DESCRIPTION OF EMBODIMENTS OF THE INVENTION

Figure 1:
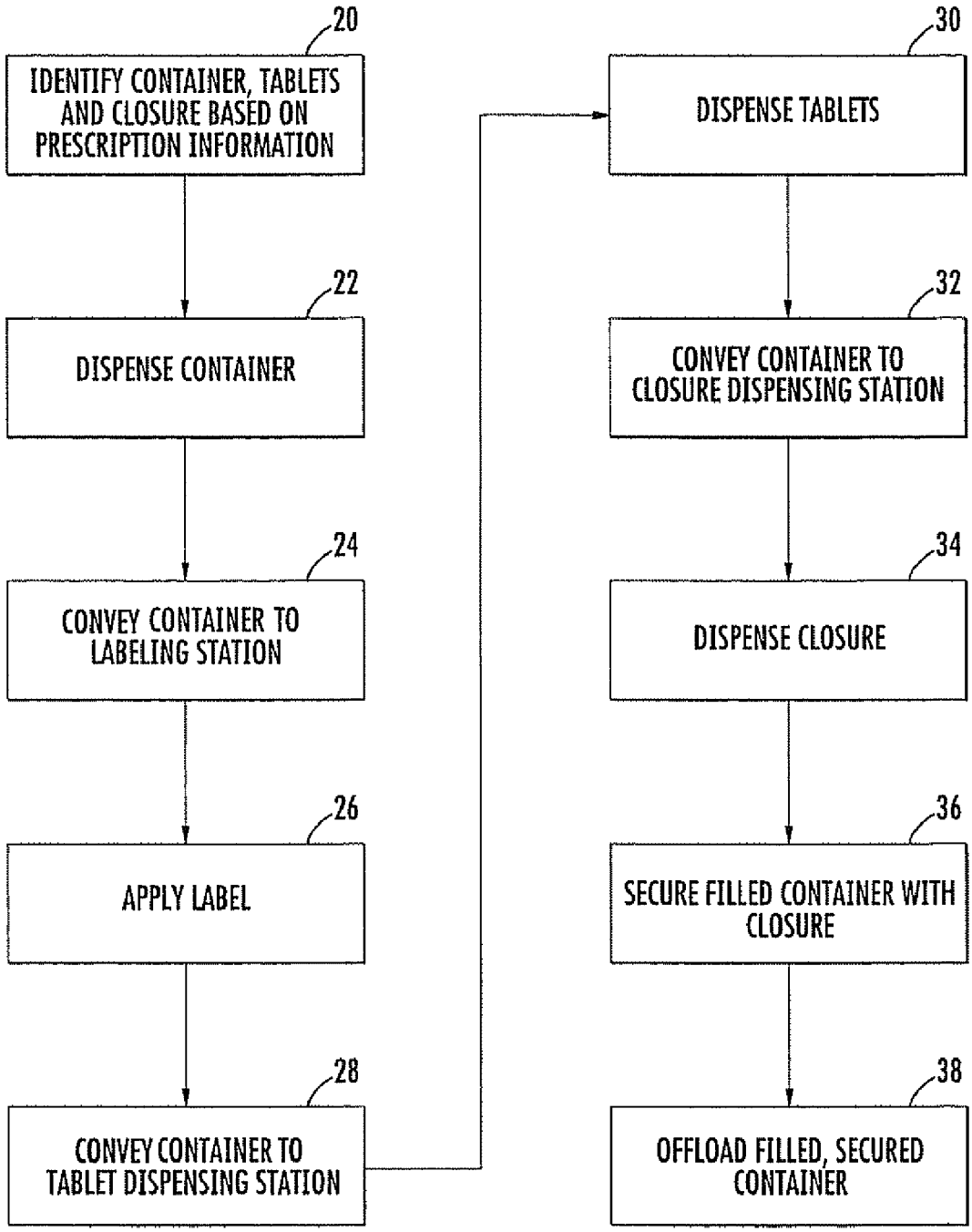
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals, and more specifically to the simulation and dispensing of closures or caps, within such a system. An exemplary overall process is described generally with reference to FIG. 1. The process begins with the identification of the proper container, tablets or capsules and closure to be dispensed based on a patient's prescription information (Box 20). A container of the proper size is dispensed at a container dispensing station (Box 22), then travels to a labeling station (Box 24). The labeling station applies a label (Box 26), after which the container travels to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
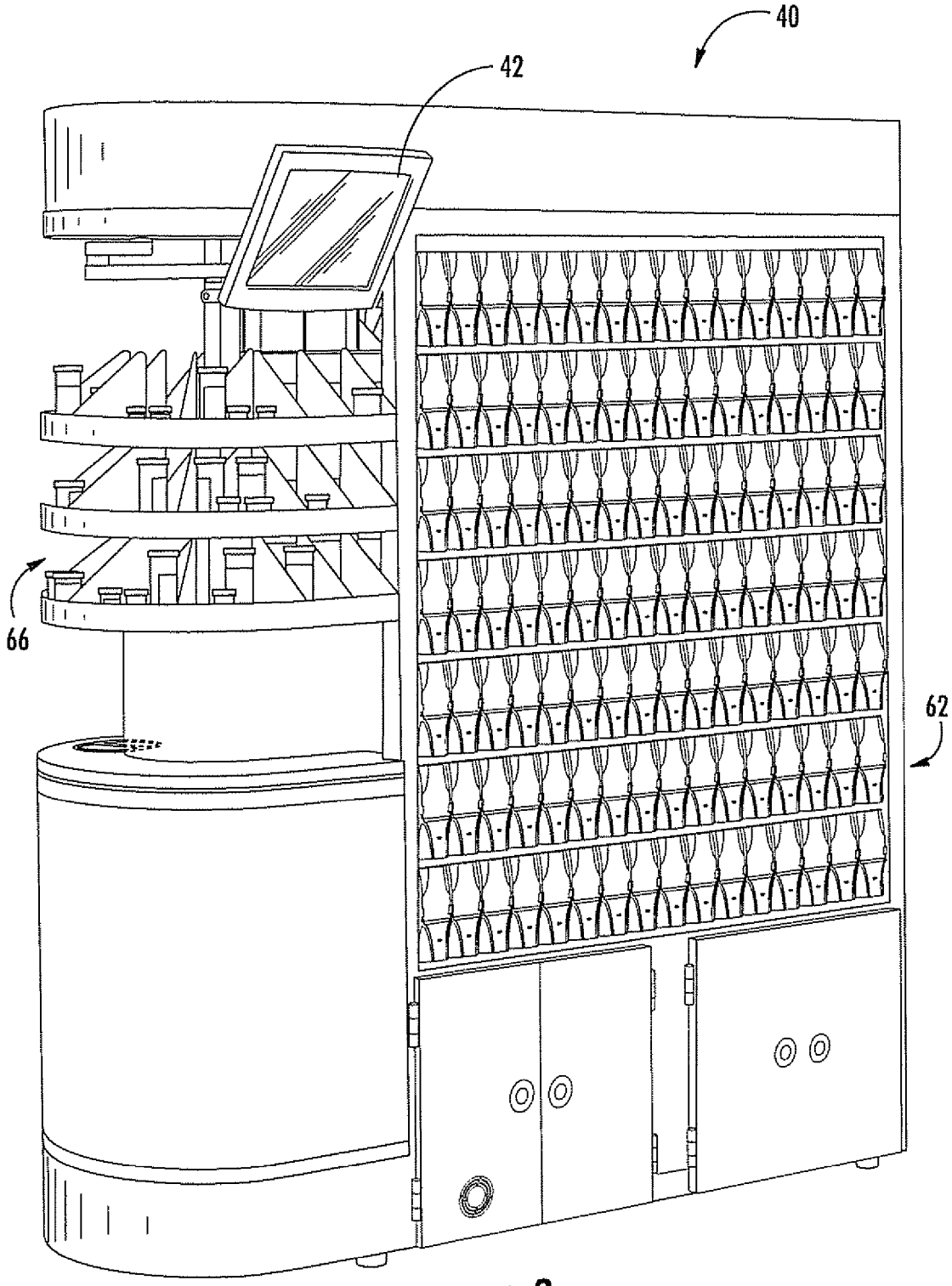
FIG. 2 is a front perspective view of a pharmaceutical tablet dispensing system according to the present invention.
Figure 3:
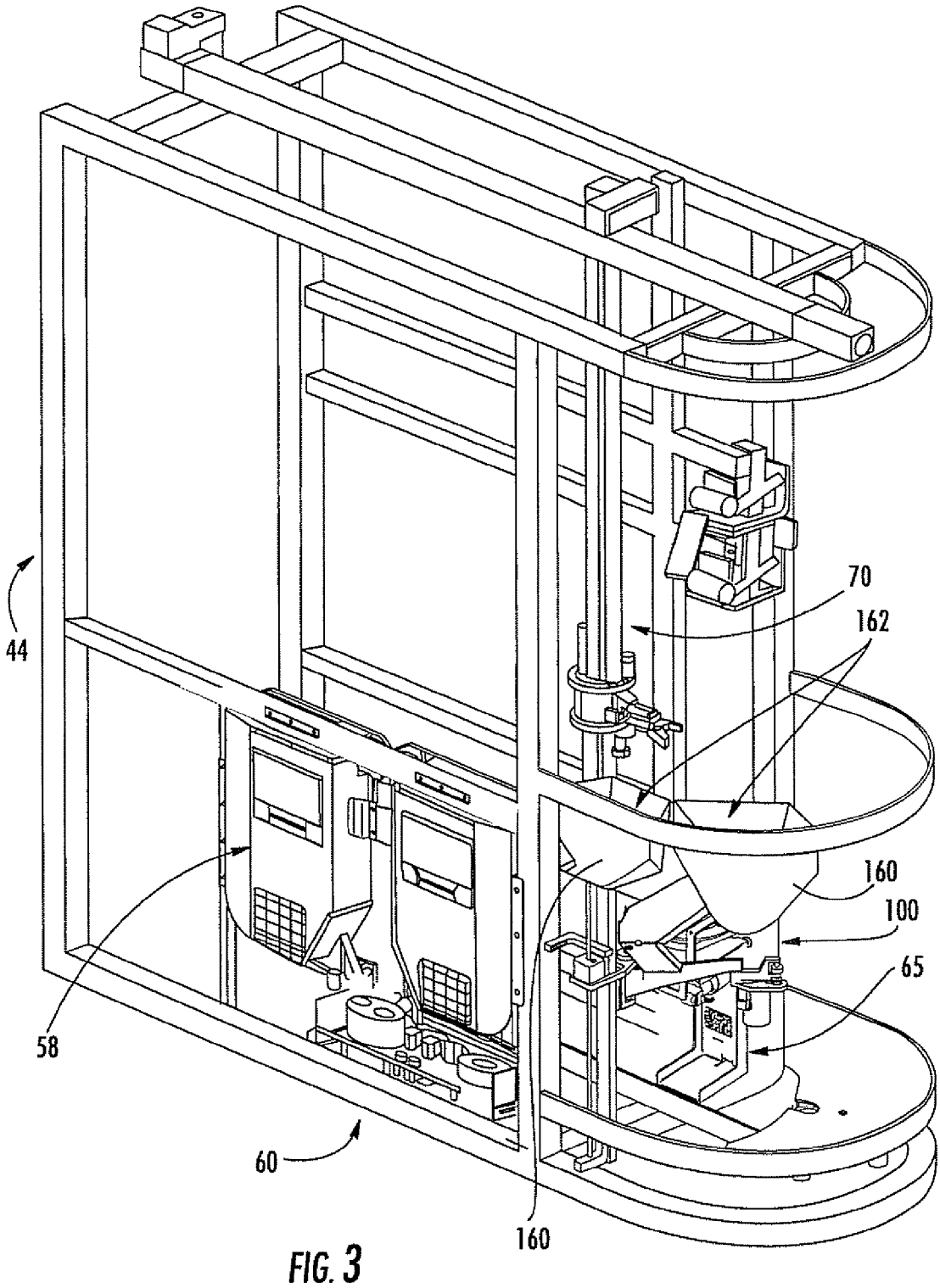
FIG. 3 is a rear cutaway perspective view of the system of FIG. 2 illustrating the support frame, the container dispensing station, the labeling station, the dispensing carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure dispensing station 100, a capping station 65, and an offloading station 66. In the illustrated embodiment, containers, tablets and closures are moved between these stations with a dispensing carrier 70; however, in some embodiments multiple carriers may be employed. With the exception of the closure dispensing station 100, which is described in detail below, examples of each of the other operative stations and the conveying devices is described in detail in U.S. Pat. No.

6,971,541 to Williams et al., the disclosure of which is hereby incorporated herein in its entirety.

Figure 4:
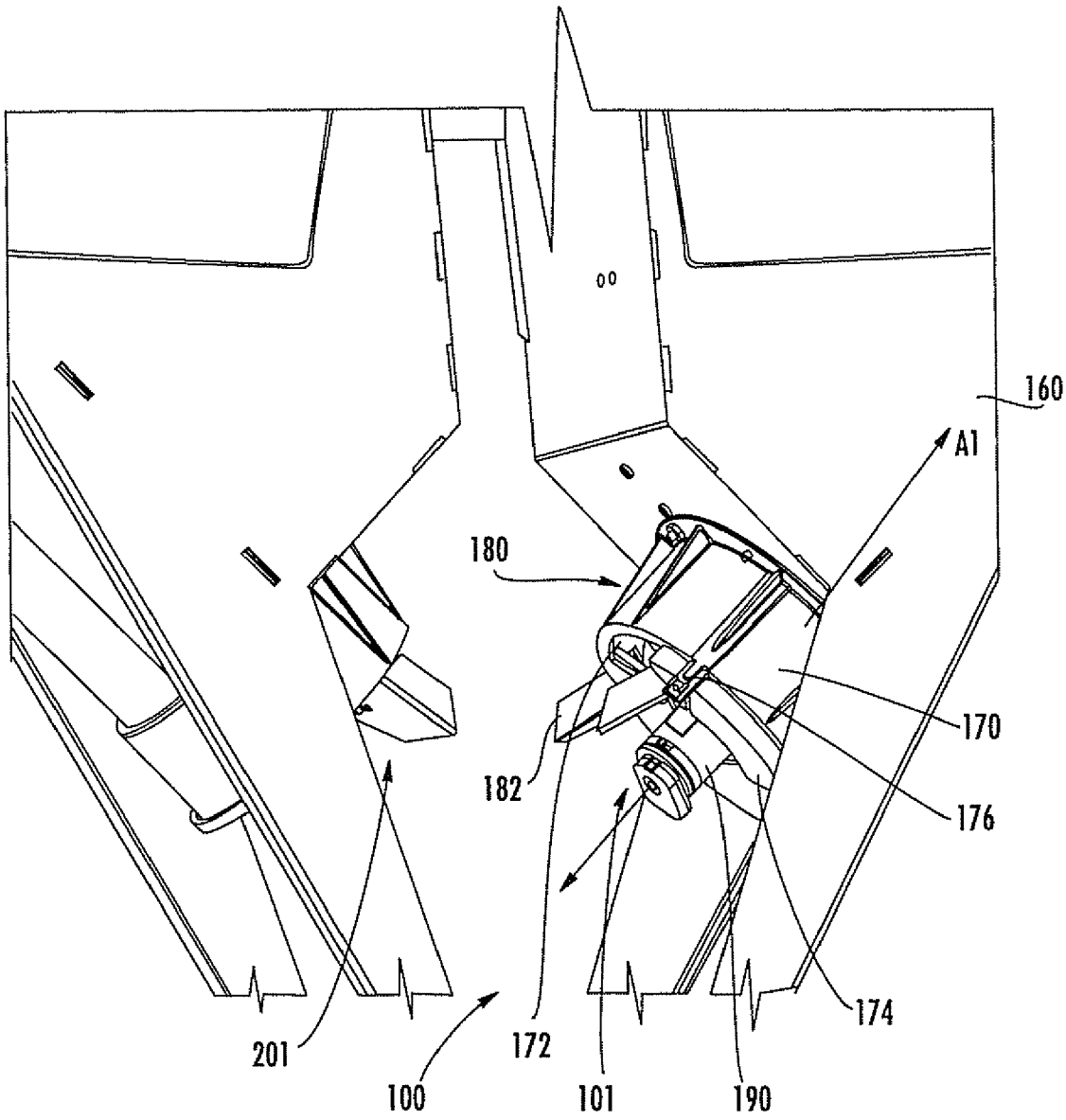
FIG. 4 is an enlarged front view of a closure dispensing station found in the system of FIG. 2.

Turning now to FIG. 4, the closure dispensing station 100 is illustrated therein. FIG. 4 shows a small cap dispenser 101 and a large cap dispenser 201. Each of the small and large cap dispensers 101, 201 includes an outer ring 102, a small drum (designated at 120 in the small cap dispenser 101 (FIGS. 8-11) and 220 in the large cap dispenser 201 (FIG. 16)), an agitation slat 150 (FIG. 12) a housing 160, and a mounting bucket 170. The closure dispensing station 100 will initially be described below with respect to the small cap dispenser 101; subsequent discussion will describe differences in the small and large drums 120, 220 and accompanying differences in the small and large cap dispensers 101, 201.

Figure 5:
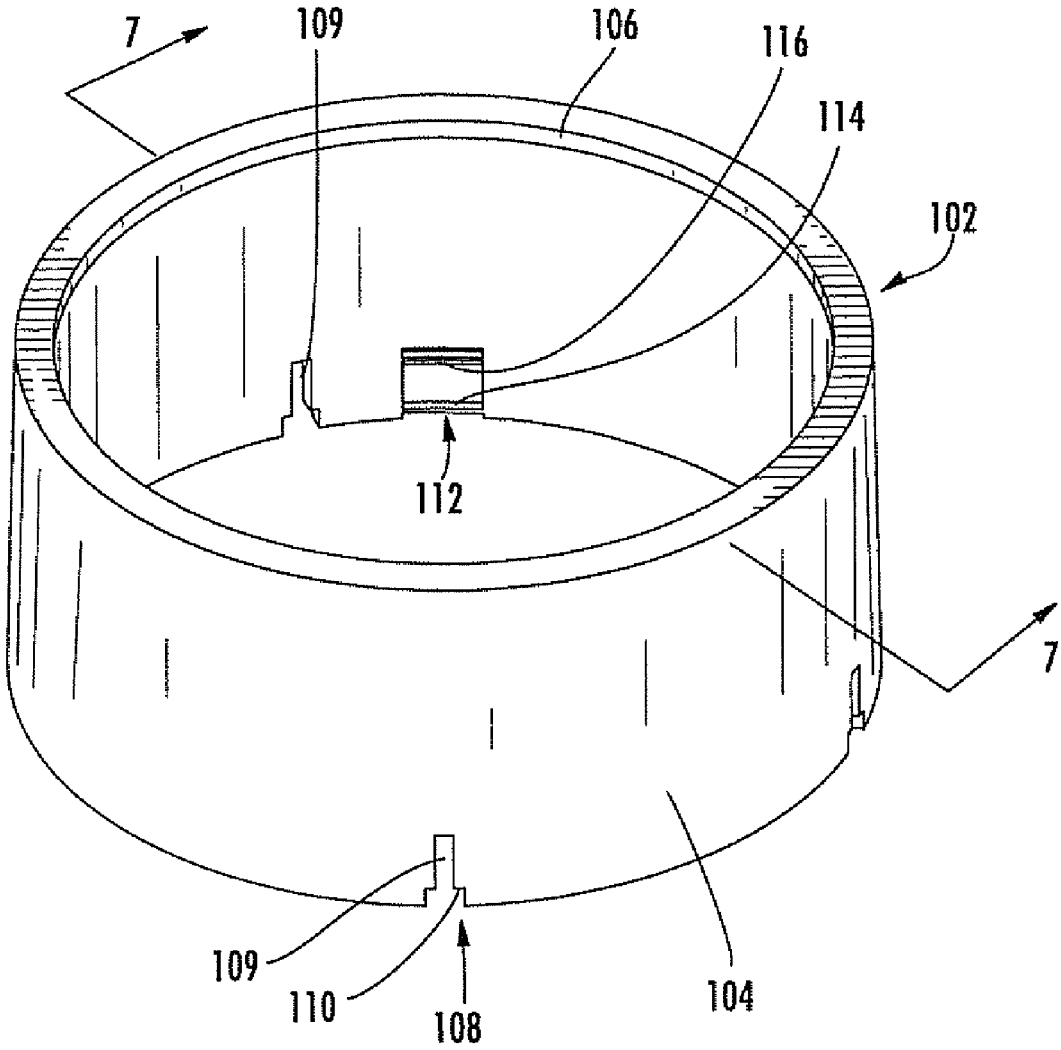
FIG. 5 is a top front perspective view of the outer ring of the closure dispensing station of FIG. 4.
Figure 6:
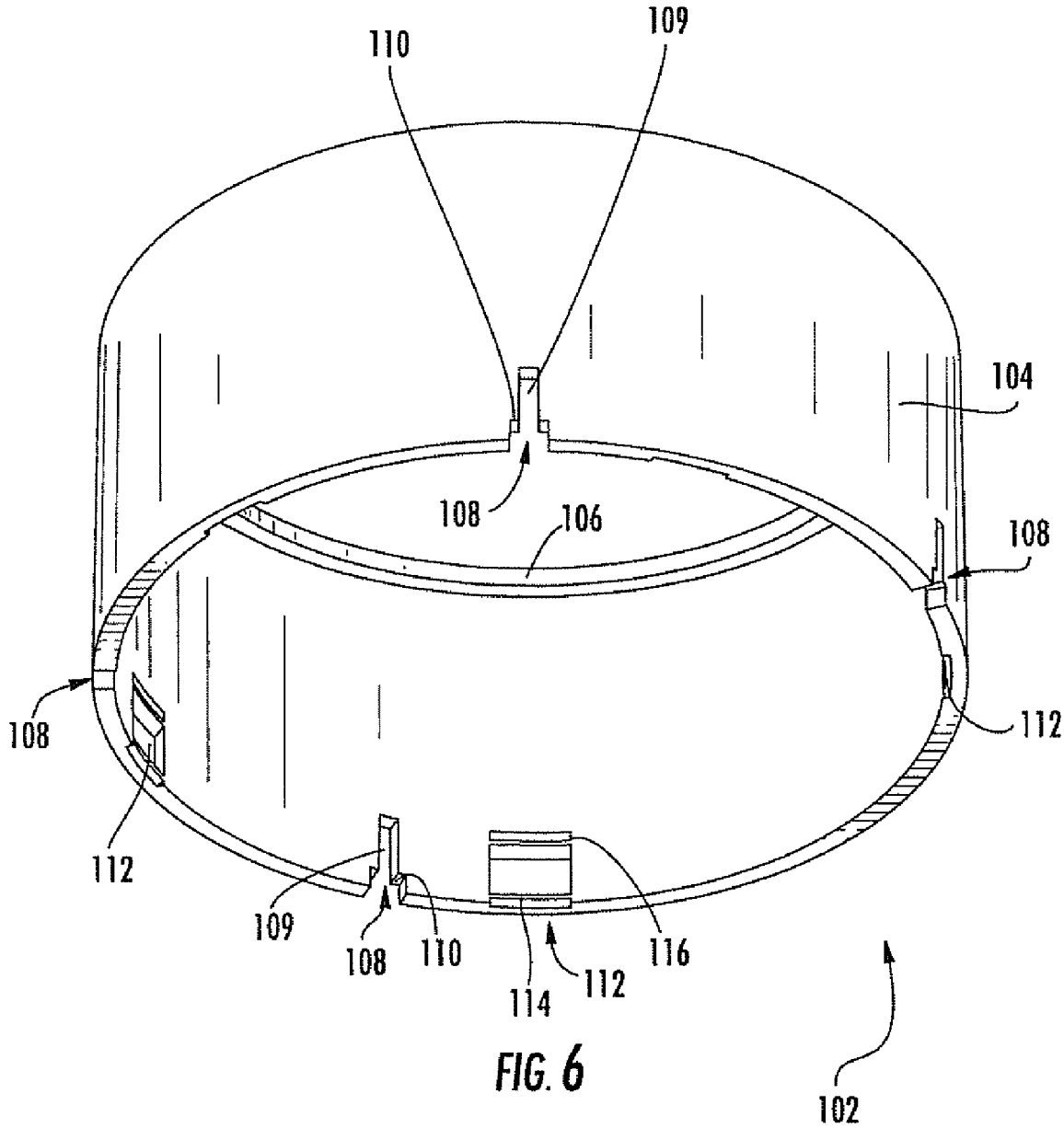
FIG. 6 is a bottom front perspective view of the outer ring of FIG. 5.
Figure 7:
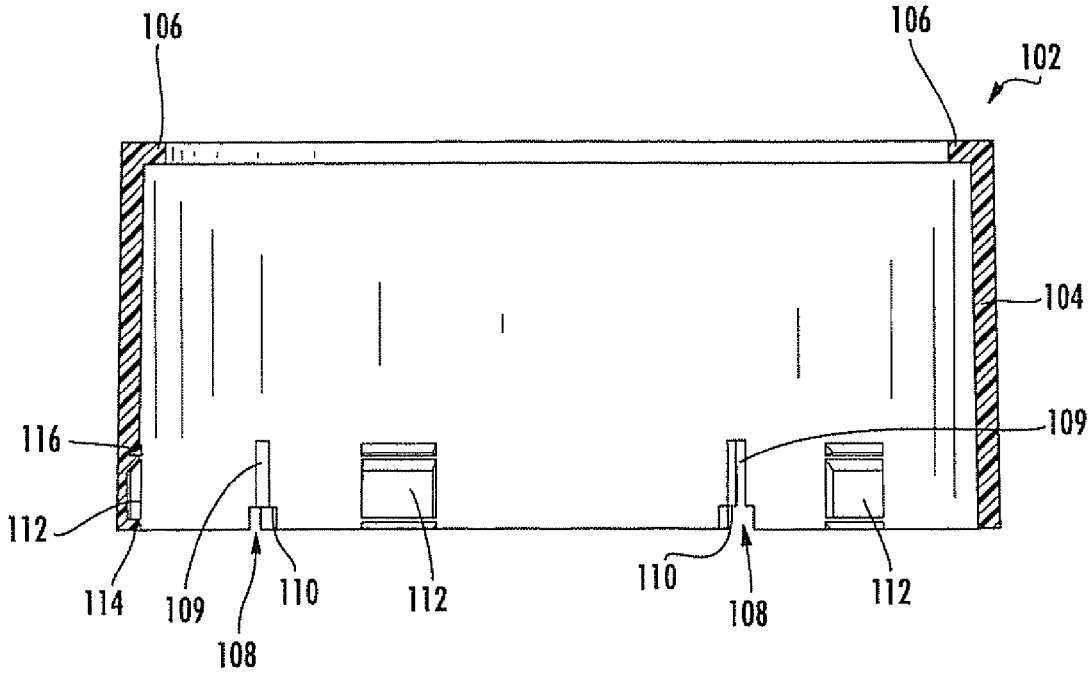
FIG. 7 is a section view of the outer ring of FIG. 5 taken along lines 7-7 thereof.
Figure 8:
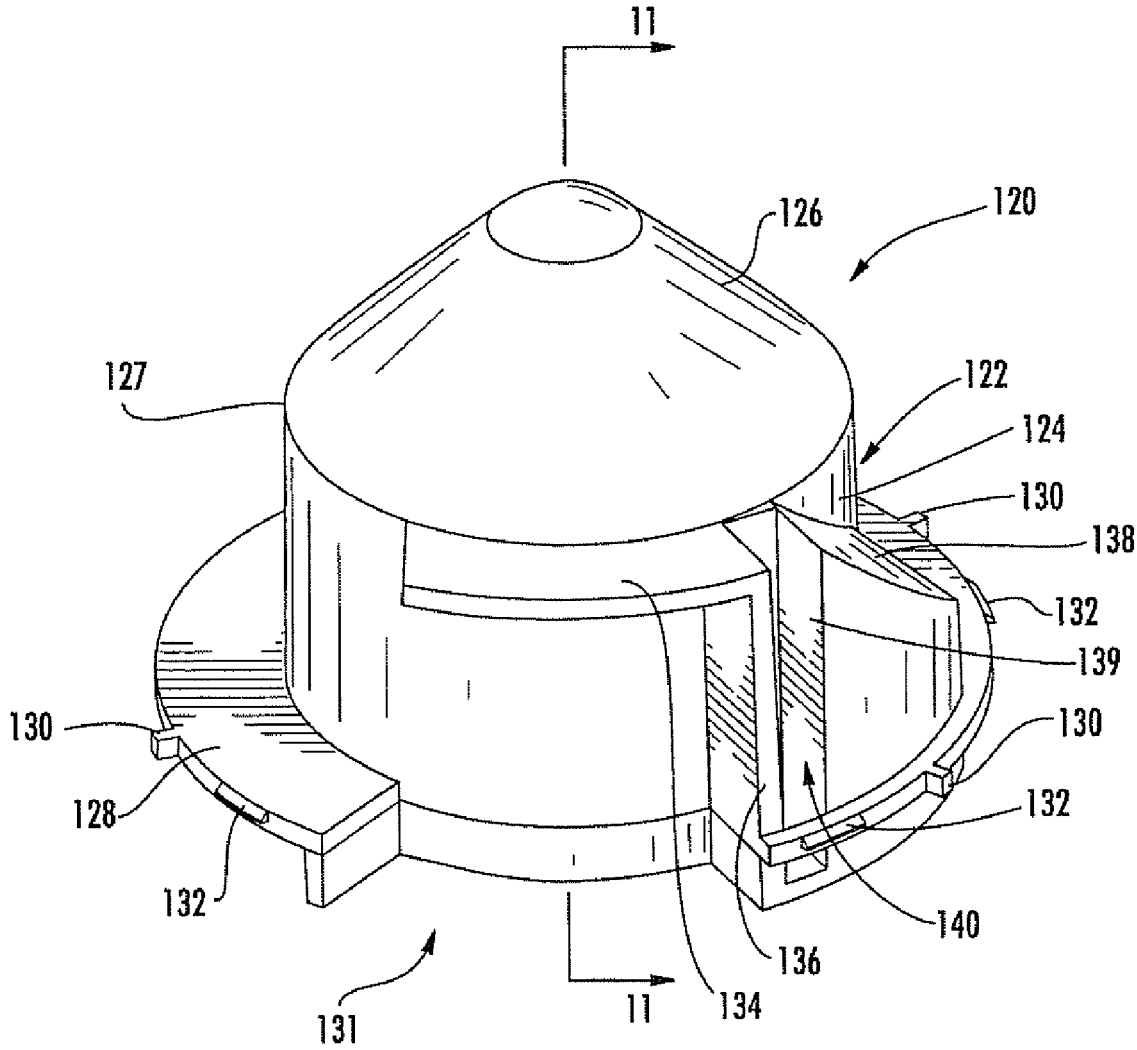
FIG. 8 is a top front perspective view of the small drum of the closure dispensing station of FIG. 4.
Figure 9:
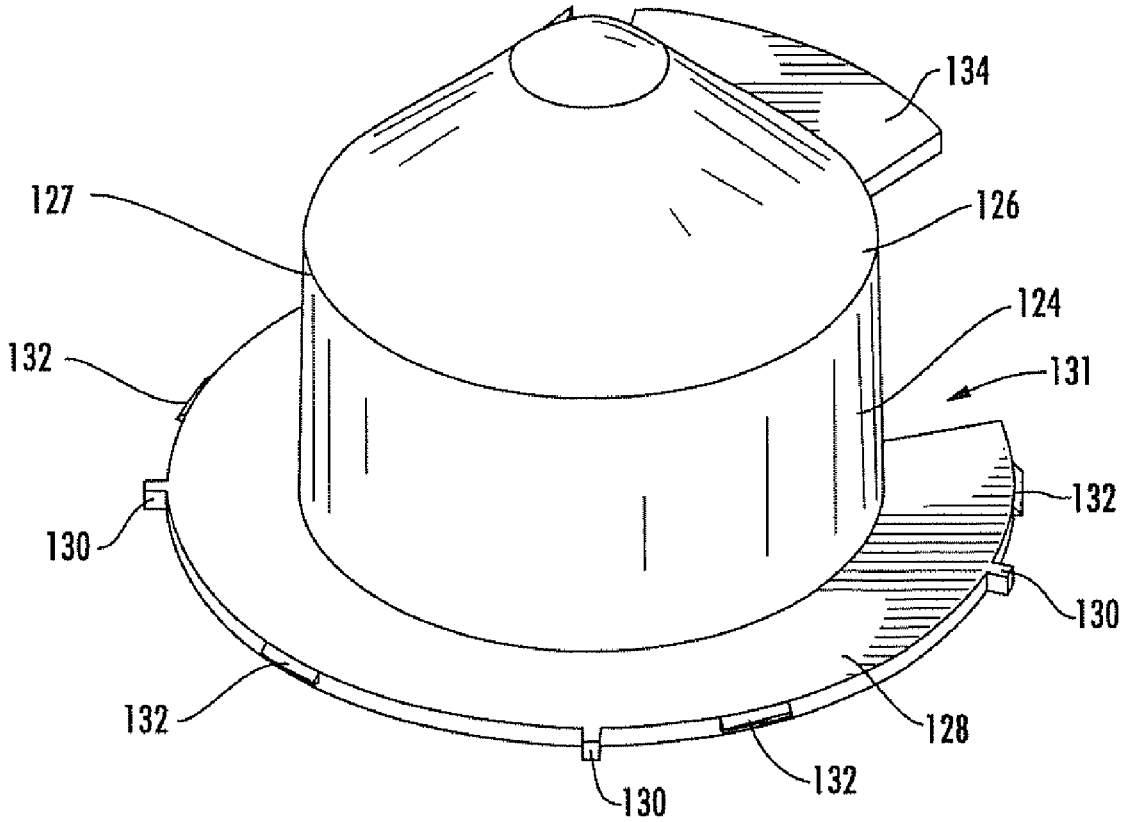
FIG. 9 is a top rear perspective view of the small drum of FIG. 8.
Figure 10:
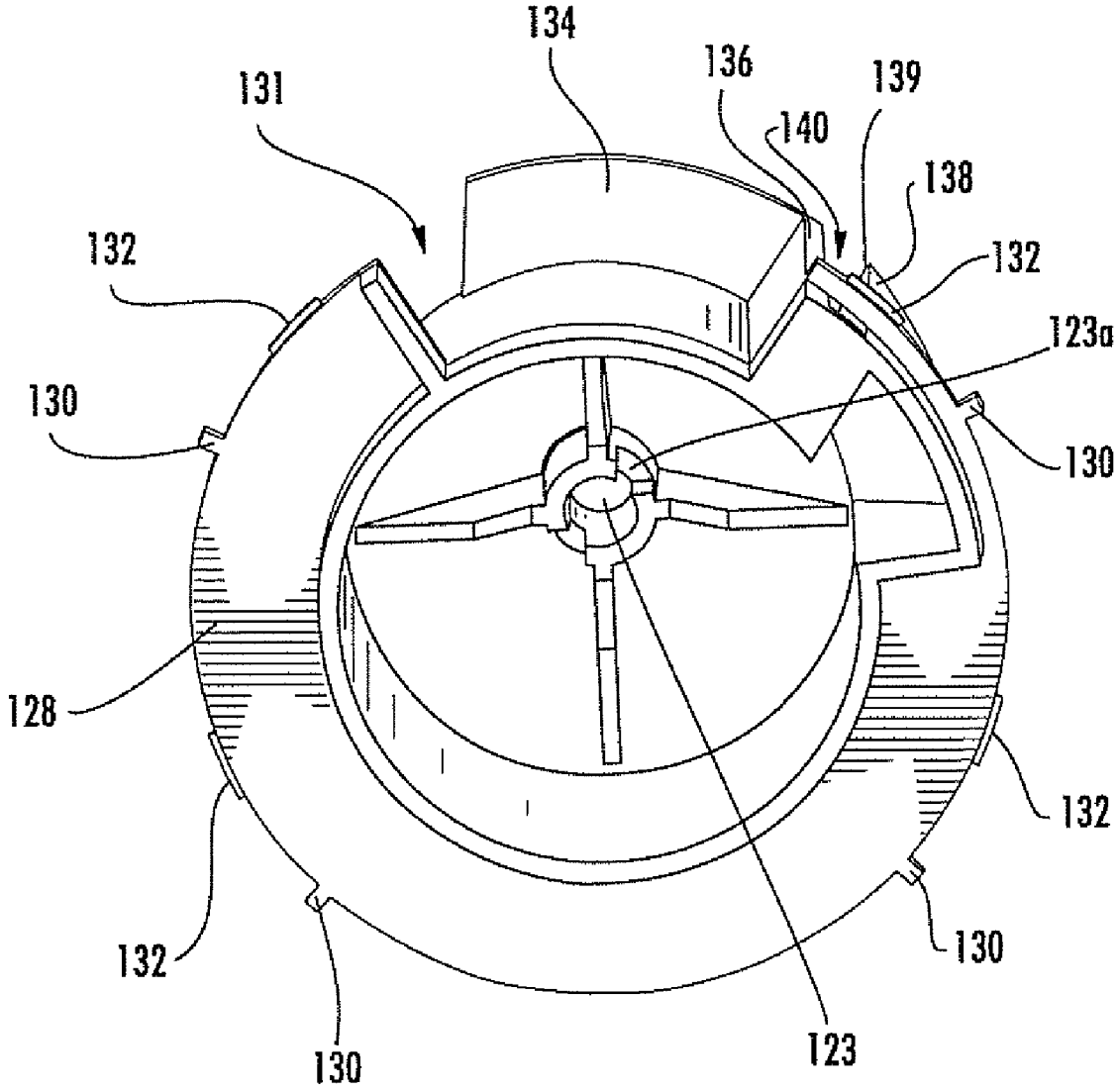
FIG. 10 is a bottom front perspective view of the small drum of FIG. 8.

Referring to FIGS. 5-7, the outer ring 102 is generally cylindrical and includes an outer wall 104. A lip 106 extends radially inwardly from the upper end of the wall 104. At its lower edge, the wall 104 includes four open-ended notches 108; each of the notches 108 has a stepped profile, such that a shoulder 110 is formed along the sides of each notch 108 below the notch upper ends 109. The inner surface of the wall 104 includes five latch recesses 112. Each of the latch recesses 112 has a lower shelf 114 that is a first distance from the lowermost edge of the outer ring 102 and an upper shelf 116 that is a second, greater distance from the lowermost edge of the outer ring 102 (see FIG. 7).

The outer ring 102 is illustratively formed as a unitary member, although it can be made as separate components and subsequently assembled. It may be formed of a polymeric material, such as glass-filled ABS, or any number of other suitable materials.

Figure 11:
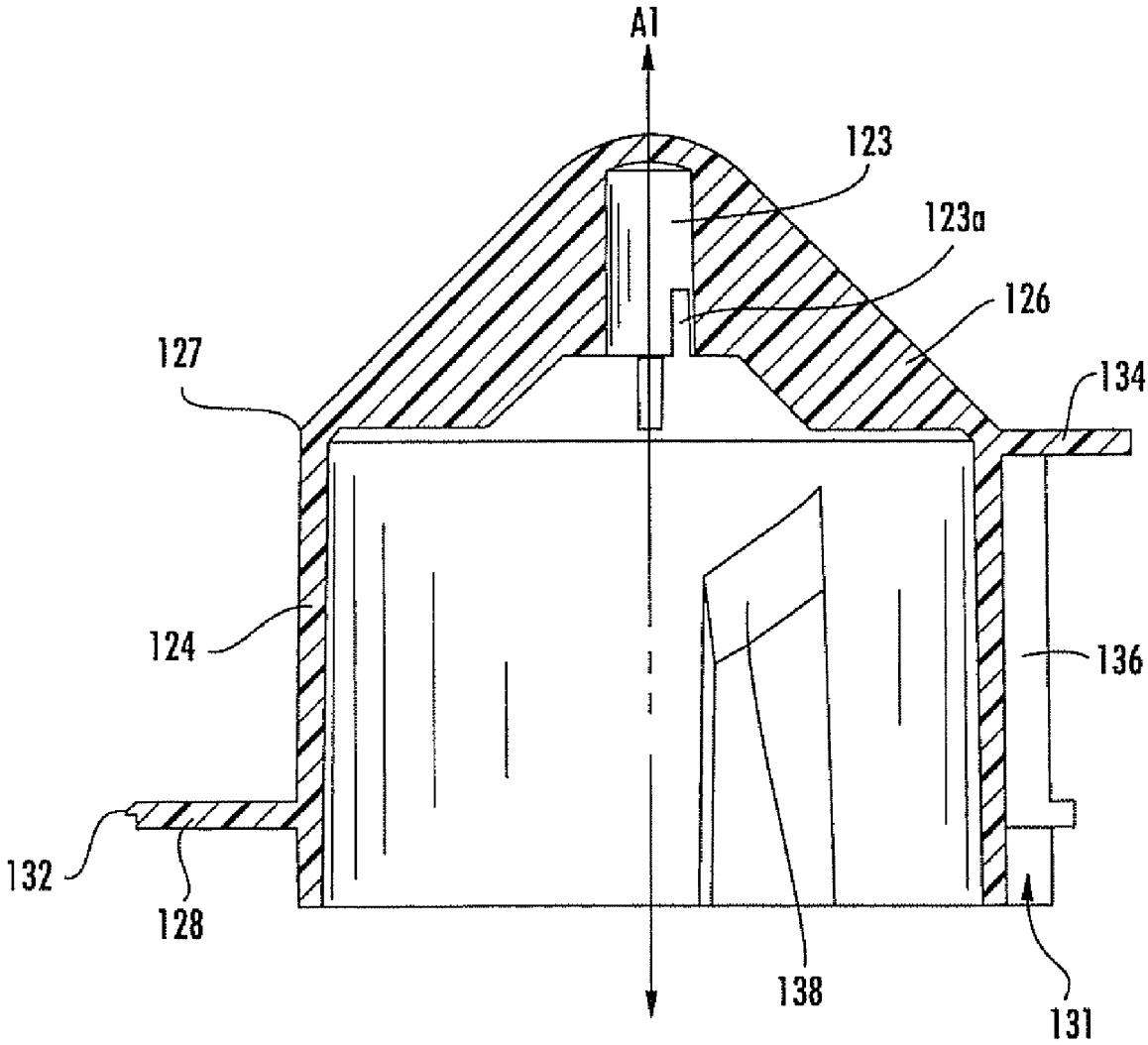
FIG. 11 is a section view of the small drum of FIG. 8 taken along, lines 11-11 thereof.

Turning now to FIGS. 8-11, the small drum 120 has a hub 122 formed with a cylindrical vertical wall 124 and a snub-nosed cone 126 on top of the wall 124. The underside of the hub 122 has a bore 123 with a slot 123*a* for receiving the shaft of a motor 190 (see FIGS. 4, 10 and 11). A circular edge 127 is formed between the upper end of the wall 124 and the lower end of the cone 126. A central axis A1 extends through the center of the cone 126 (FIG. 11).

An outer platform 128 extends radially from the wall 124 from a location above the lower edge of the wall 124. The outer platform 128 extends circumferentially over an arc of approximately 250 degrees around the wall 124, with a discontinuity 131 being formed between the ends of the platform 128. Four nubs 130 sized and configured to fit within the upper ends of the notches 108 of the outer ring 102 extend radially outwardly from the platform 128. Also, five projections 132 extend radially outwardly from the platform 128 and are sized and configured to be received on the upper shelves 116 of the latch recesses 112 in the outer ring 102.

Referring still to FIGS. 8-11, the small drum 120 also includes an upper shelf 134 that is located even with the edge 127 and above the discontinuity 131 in the platform 128. A vertical wall 136 extends downwardly from one end of the shelf 134. A ramp 138 is located radially outwardly of the wall 124. A vertical wall 139 (best seen in FIG. 8) forms the rear end of the ramp 138 and is located in spaced apart relationship from the wall 136 such that a gap 140 is formed therebetween. The ramp 138 slopes downwardly as it extends circumferentially away from the wall 139.

The small drum 120 is illustratively formed as a unitary member, although it can be made as separate components and subsequently assembled. It may be formed of a polymeric material, such as glass-filled ABS, or any number of other suitable materials.

Figure 12:
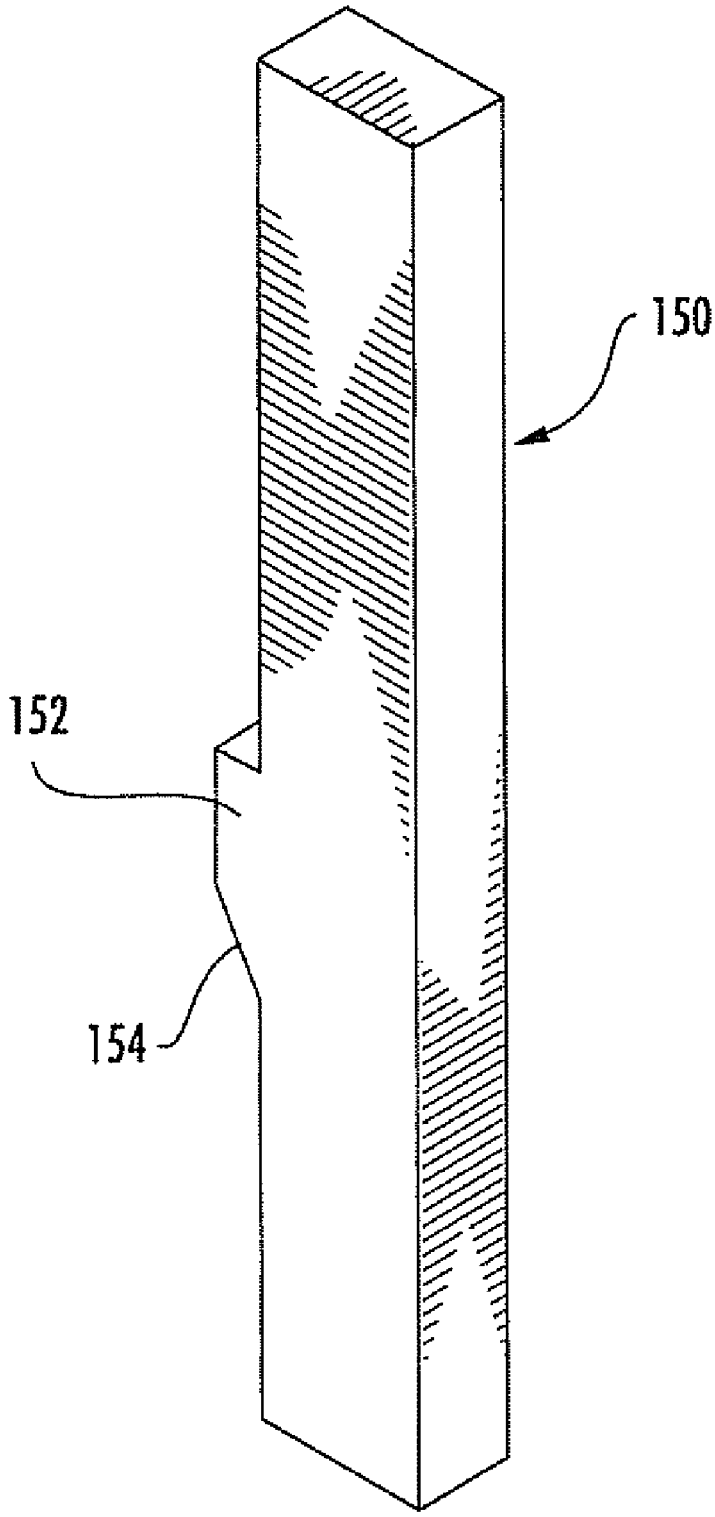
FIG. 12 is a perspective view of the agitation slat of the closure dispensing station of FIG. 4.

The closure dispensing station 100 also includes an agitation slat 150 (FIG. 12). In its central portion, the agitation slat 150 includes a projection 152 with a sloped lower surface 154. The agitation slat 150 is typically flexible and may be formed of an elastomeric material, such as polyurethane or rubber.

Figure 13:
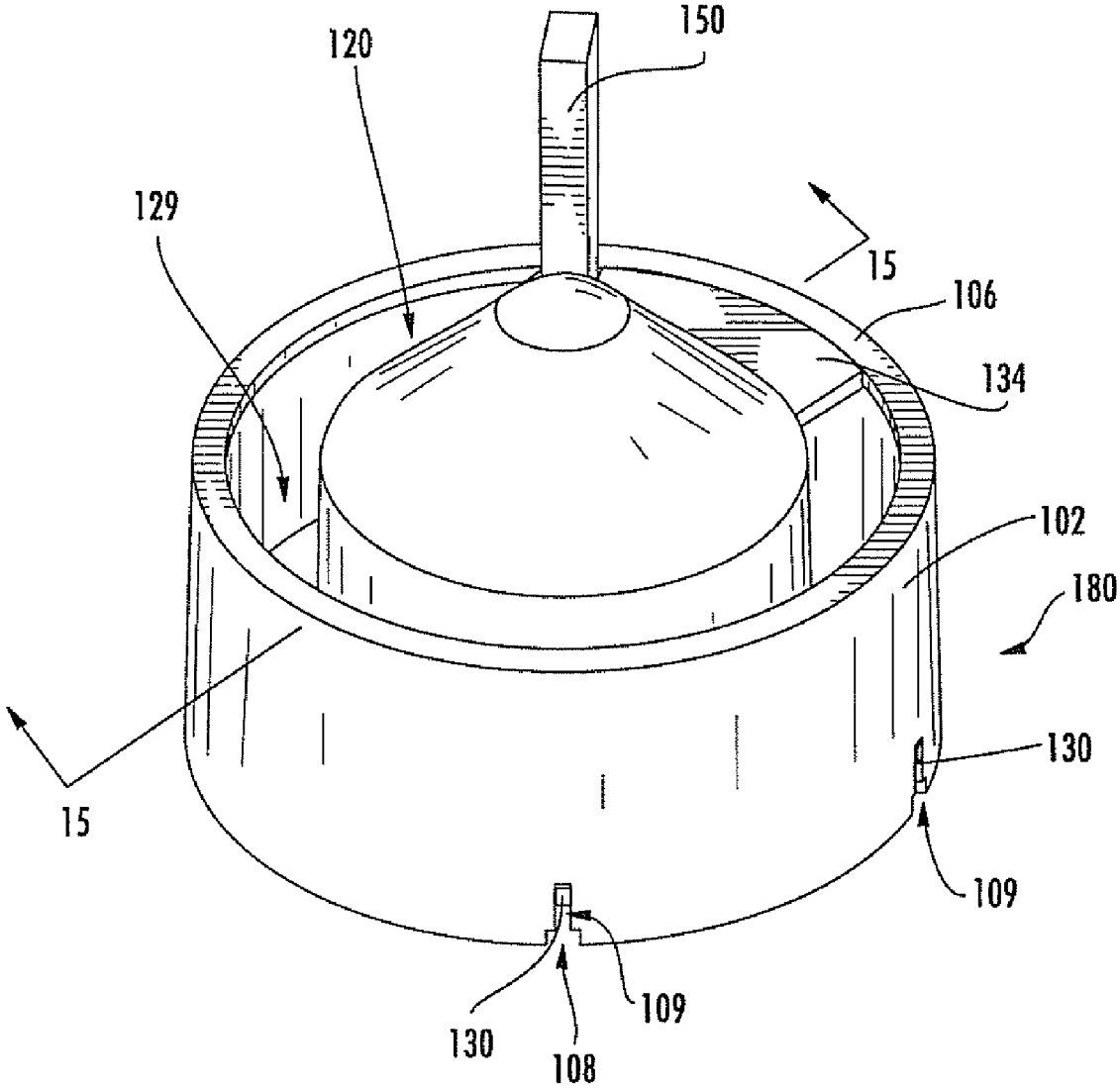
FIG. 13 is a top front perspective view of the small drum assembly of the closure dispensing station of FIG. 4.
Figure 14:
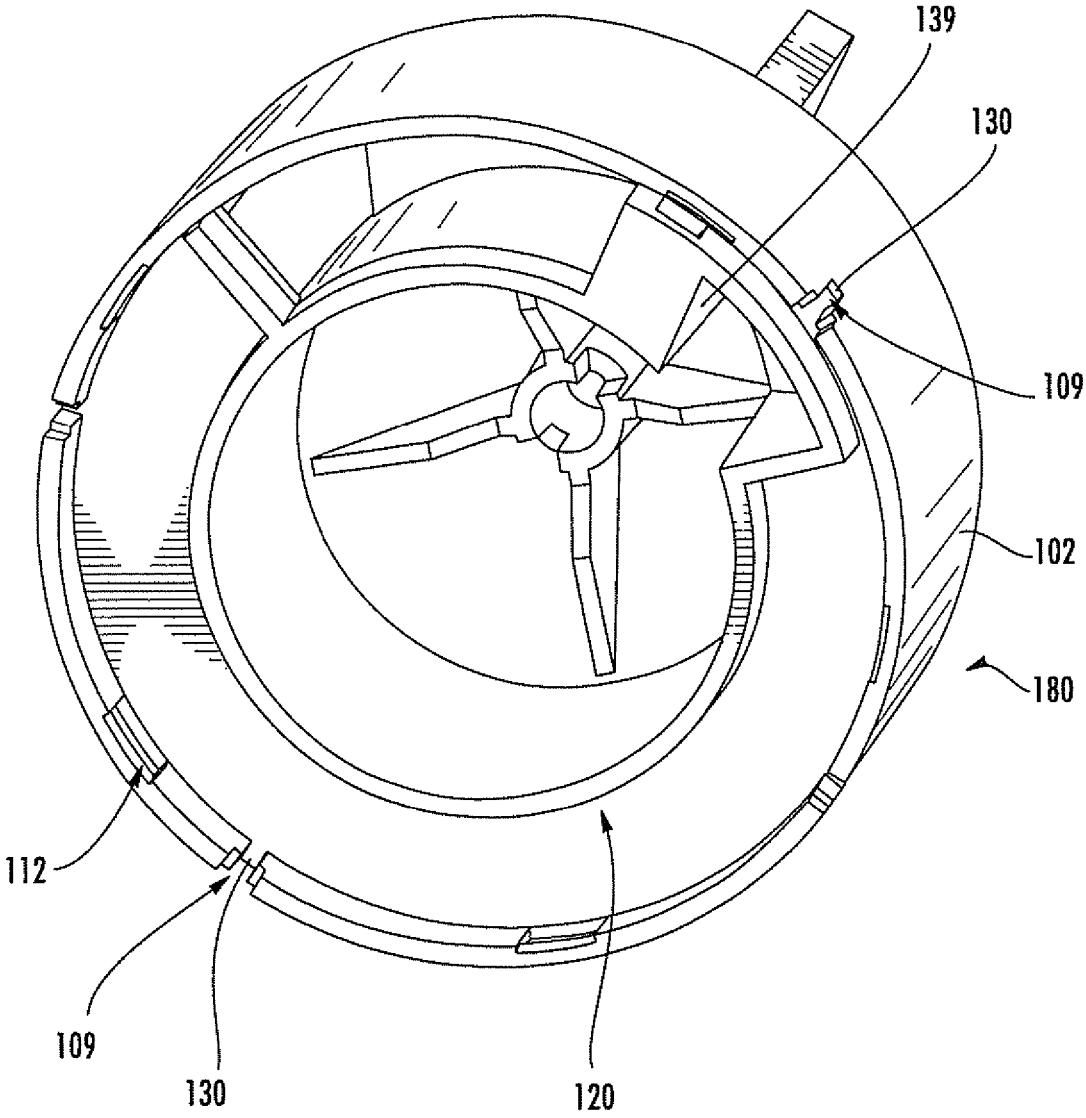
FIG. 14 is a bottom rear perspective view of the small drum assembly of FIG. 13.
Figure 15:
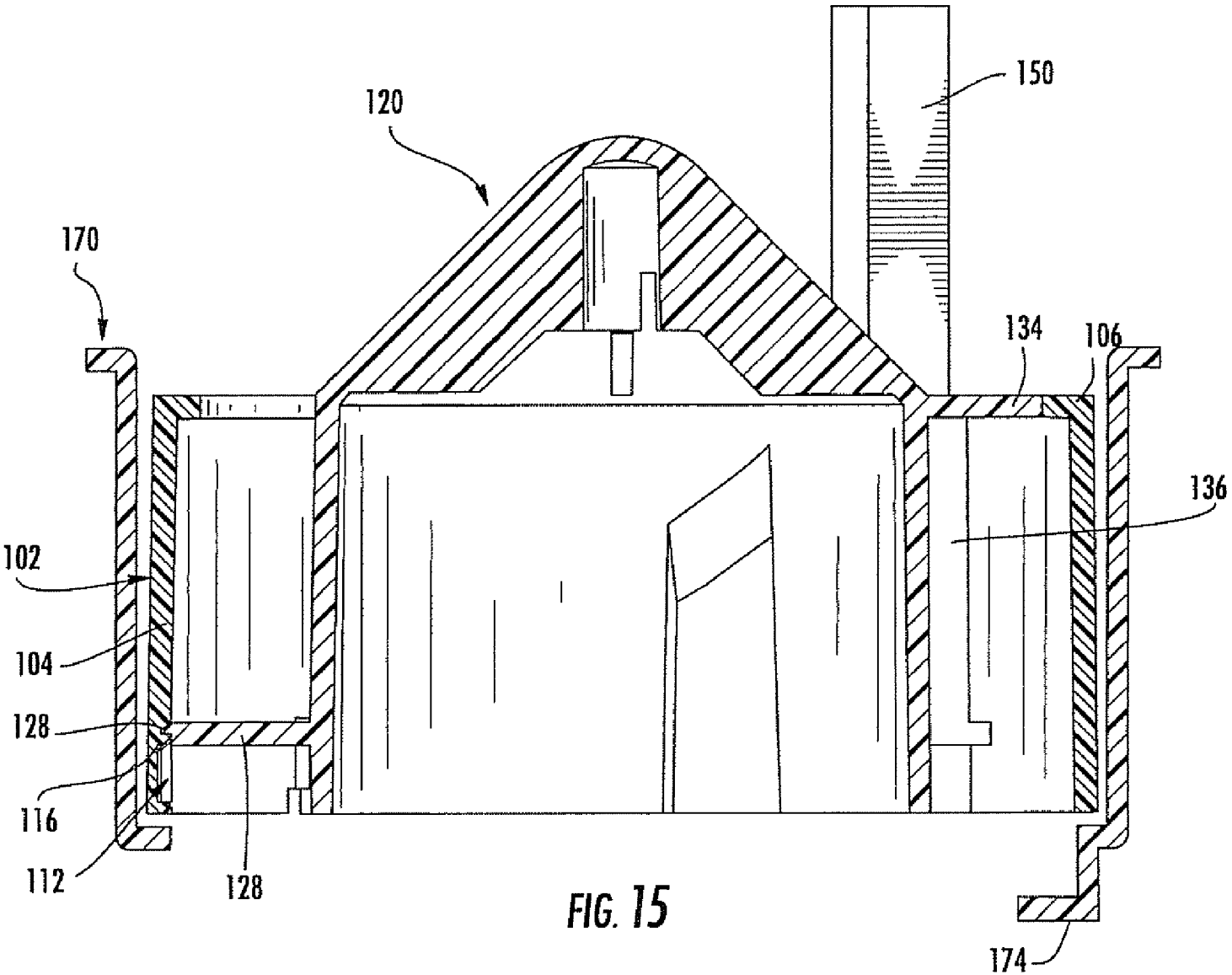
FIG. 15 is a section view of the small drum assembly of the closure dispensing station of FIG. 13 taken along section lines 15-15 thereof; the mounting bucket is also shown.

Turning now to FIGS. 13-15, it can be seen that the small drum 120 and agitation slat 150 can be inserted into the outer ring 102 to form a small drum assembly 180. The small drum 120 fits within the outer ring 102, with the nubs 130 being received in the upper ends 109 of the notches 108 and the projections 132 resting on the upper shelves 116 of the latch recesses 112. The platform 128 extends to the inner surface of the outer wall 104 of the outer ring 102, such that a gap 129 is formed above the platform 128. The radially outward edge of the upper shelf 134 abuts the inner edge of the lip 106. The lower end of the agitation slat 150 is inserted into the slot 140 (not visible in FIGS. 13-15) between the walls 136, 139. The lower surface 154 of the alignment projection 152 rests against the cone 126 (also not visible in FIGS. 13-15).

Turning back to FIG. 4, the housing 160 is hollow and is sized and configured to be positioned above and mate with the outer ring 102. As such, the housing 160 serves as a hopper for holding randomly distributed caps to be singulated. The housing 160 is fixed to the frame 44 and includes a lower end 162 that is open to provide caps to the small drum assembly 180. The housing 160 can be formed of virtually any material known to be suitable for retaining objects for dispensing.

Referring still to FIG. 4, the small drum assembly 180 is mounted underneath the housing 160 within the mounting bucket 170, which is fixed to the frame 44. As can be seen in FIG. 4, the small drum assembly 180 is typically mounted such that the axis Al of the small drum 120 is disposed at an angle of between about 40 and 50 degrees to the underlying surface; in some embodiments, the axis A1 is disposed at an angle of between about 44 and 46 degrees to the underlying surface. The mounting bucket 170 includes an arcuate exit aperture 172 that is located above and extends for approximately 90 degrees about the axis A1. The exit aperture 172 is fed through the discontinuity 131 of the outer platform 128 when the discontinuity 131 is positioned above the exit aperture 172. A pre-staging platform 174 is positioned below a portion of the exit aperture 172. A proximity sensor 176 connected to the controller 42 is mounted adjacent the pre-staging platform 174.

Figure 17A:
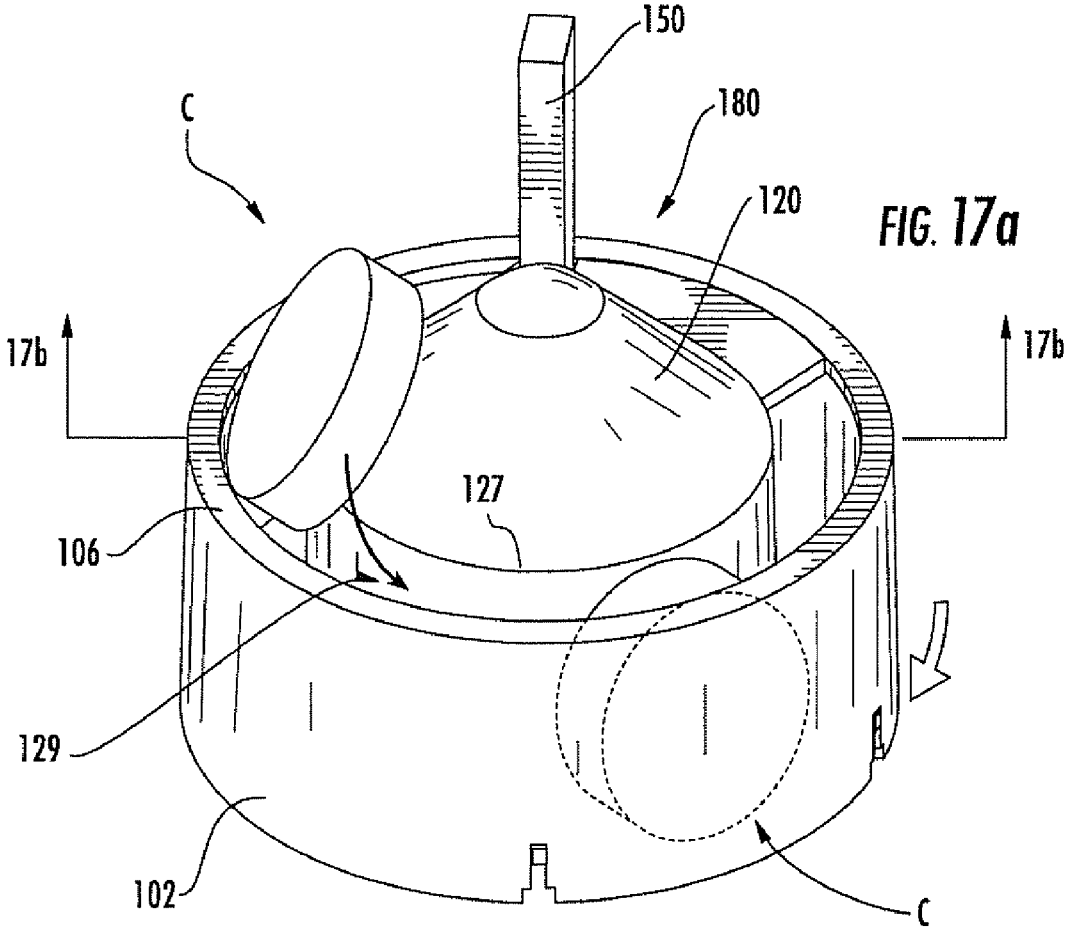
FIG. 17*a* is a front perspective view of the closure dispensing station of FIG. 4 showing a cap entering the groove of the small drum assembly.
Figure 17B:
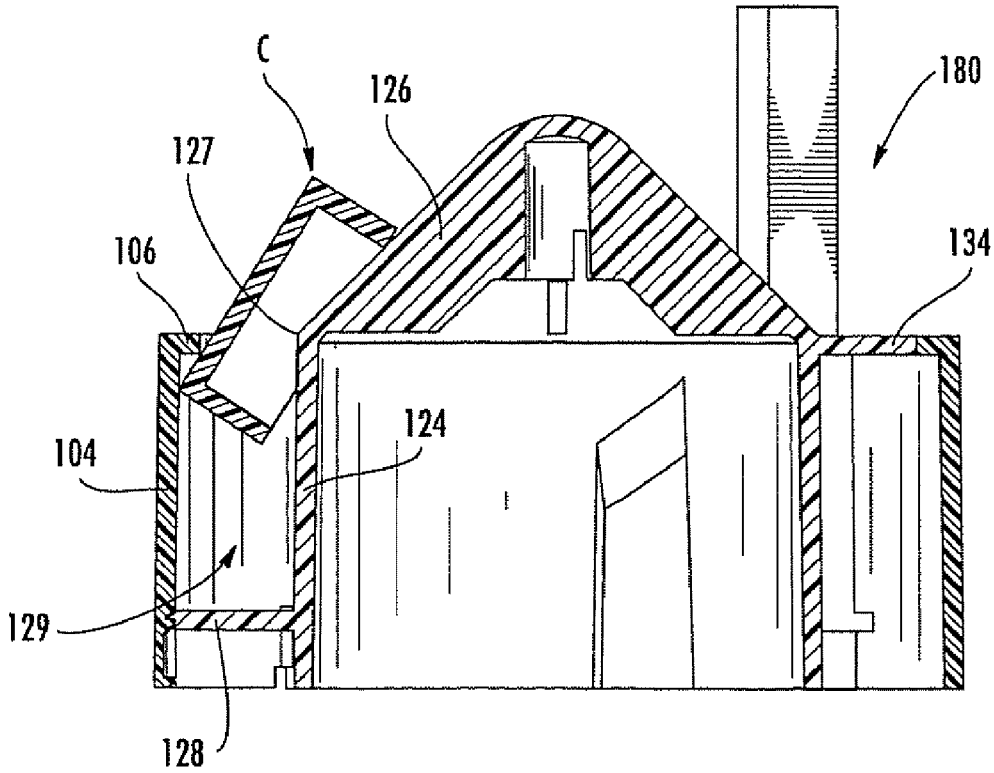
FIG. 17*b* is a section view of the small drum assembly and cap of FIG. 17*a* taken along lines 17*b*-17*b* thereof.

In operation, the closure dispensing station 100 is oriented as shown in FIG. 4. The housing 160 is filled with caps of a desired size. The controller 42 signals the closure dispensing station 100 to dispense a cap (for example, when a vial has been labeled and filled, or if it is desired to pre-stage a cap). Upon receiving the signal from the controller 42 to dispense a small cap, the motor 190 rotates the small drum assembly 180 about the axis A1 (rotation is clockwise from the vantage point of FIG. 17*a* and counterclockwise from the vantage point of FIG. 4). As described in Williams '541, supra, rotation of the small drum assembly 180 agitates the caps in the housing 160 (this agitation can be facilitated by the agitation slat 150). Eventually, a cap C descends from the housing 160 into the gap 129 (see FIGS. 17*a* and 17*b*). As explained in detail in Williams '541, the open-ended shape of the cap C, the width of the gap 129, and the arcuate shape of the edge 127 allow the cap C to enter the gap 129 only in an orientation in which the open end of the cap C faces the edge 127. The cap C may enter the gap 129 at any point thereof.

Figure 17C:
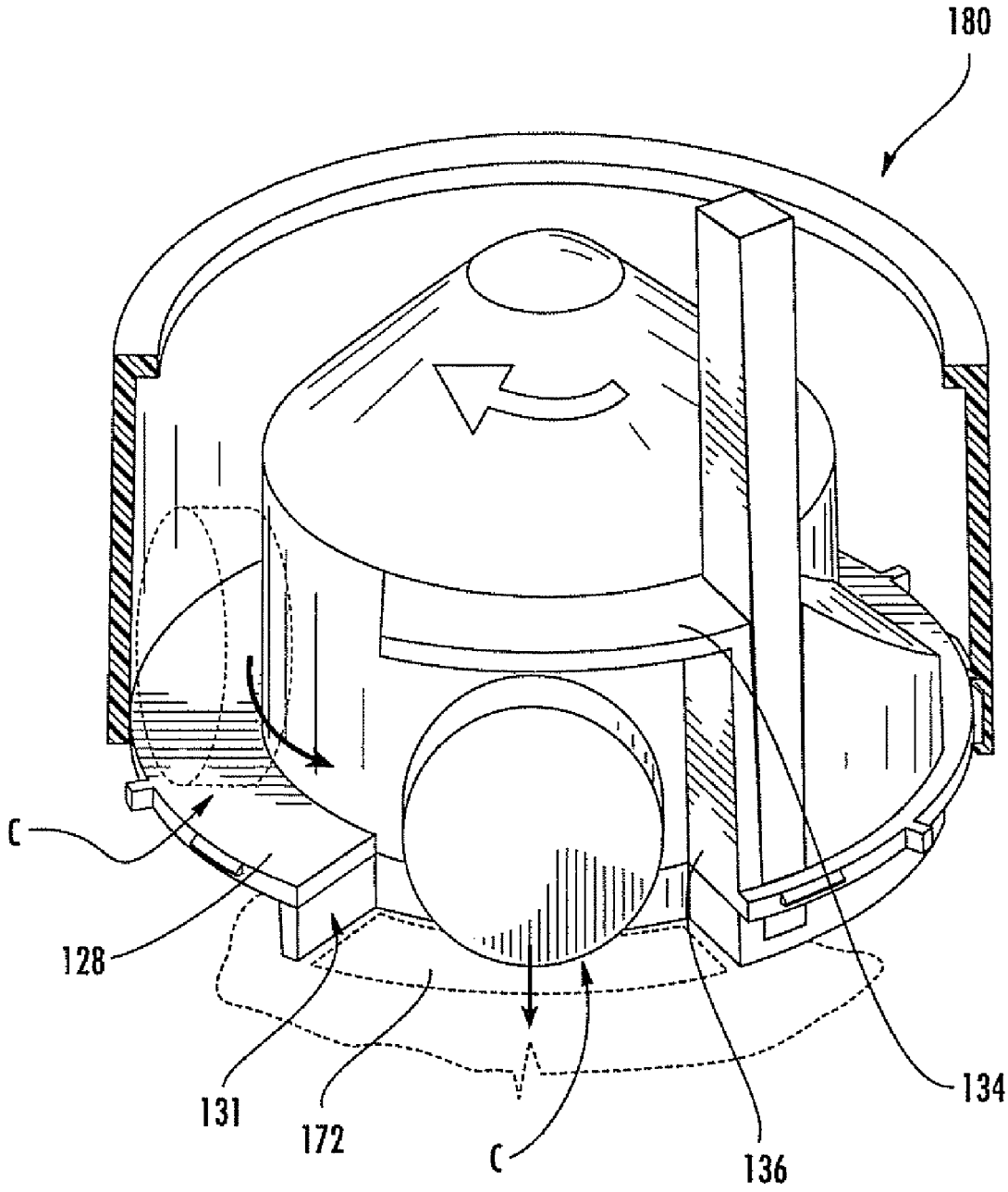
FIG. 17*c* is a partial section view of the small drum assembly of FIG. 17*a* showing the movement of the cap in the groove and passing out of the small drum assembly.

Once in the gap 129, as the small drum assembly 180 rotates the cap C rolls or slides on or is otherwise conveyed by the platform 128 until the cap C is positioned in the discontinuity 131 and rests against the vertical wall 136 (FIG. 17*c*). The small drum assembly 180 continues to rotate until the discontinuity 131 is positioned over the outlet slot 172, at which time the cap C descends through the outlet slot 172 to the pre-staging platform 174, where it is pushed by the vertical wall 136 to a position adjacent the sensor 176 (see FIG. 4). The sensor 176 then signals the controller 42 to cease the rotation of the small drum assembly 180. At this point, the cap C is pre-staged and is ready to be dispensed to the next filled, labeled vial.

When the controller 42 receives word again that a cap C is needed, the controller 42 initiates rotation of the small drum assembly 180, which rotation slides the pre-staged cap C to the end of the pre-staging platform 174 and into a chute 182 (FIG. 4) that conveys the cap C to the capping station 65, where the cap C is applied to the filled, labeled vial. The small drum assembly 180 continues to rotate until another cap C has descended from the housing 160 into the gap 129 and been conveyed onto the pre-staging platform 174. In this manner the closure dispensing station 100 can immediately provide a cap C (i.e., a pre-staged cap) for the capping of a vial (thus not slowing the entire process practiced by the system 40 by waiting for the singulation of a cap), while singulating another cap C and pre-staging it for subsequent use.

Figure 16:
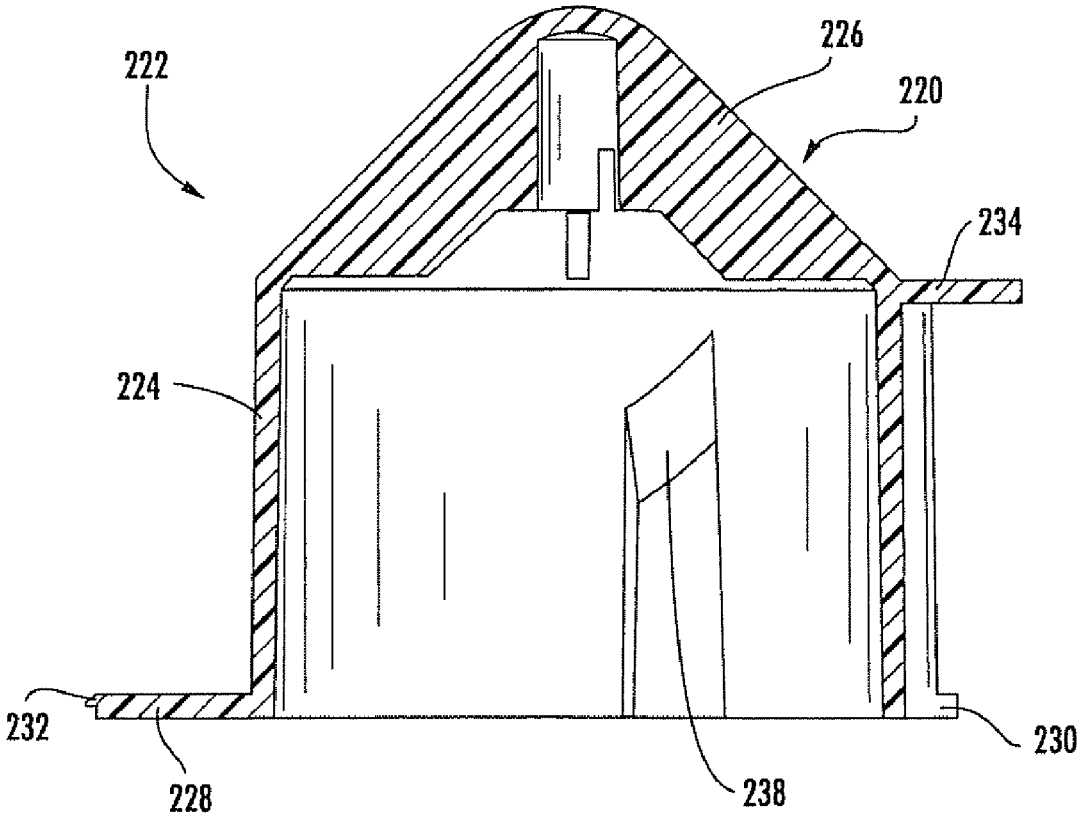
FIG. 16 is a front section view of a large drum that can be used in the closure dispensing station of FIG. 4.

Turning now to FIG. 16, it can be seen that a large drum 220 can be substituted for the small drum 120 in the event singulation of caps of a different size are desired. Generally speaking, the small drum 120 (which has a gap 129 with a height of between about 1.75 and 2.0 inches) may be used for caps of 1.15 to 1.90 inch diameter, while the large drum 220 (which has a gap with a height of between about 2.25 and 2.5 inches) may be used for caps of 2.0 to 2.4 inch diameter. The large drum 220 is similar in configuration to the small drum 120, having a hub 222 formed of a vertical wall 224 and a cone 226 as well as an outer platform 228, an upper shelf 234, and a ramp 238; however, the outer platform 228 extends radially outwardly from the lower edge of the wall 224, and the nubs 230 on the outer edge of the platform 228 are wider than the upper ends of the notches 108. As a result, when the large drum 220 is inserted into the outer ring 102 to form a large drum assembly 280, the nubs 230 fit into the lower portions of the notches 108, and the projections 232 on the outer platform 228 are inserted onto the lower shelves 114 of the latch recesses 112. This positioning of the outer platform 228 is appropriate for larger caps; the platform 128 of the small drum 120 is raised to prevent the vertical stacking of caps in the gap 129.

Thus, it can be seen that, by having two different sets of shelves 114, 116 and two different levels in the notches 108, the same size outer ring 102 can be employed with either the small drum 120 or the large drum 220. As a result, manufacturing of the closure dispensing station 100 can be simplified.

Those skilled in this art will recognize that other mating structures for assembly of the drums 120, 220 and the outer ring 102 may be employed. For example, nubs may be present on the outer ring and receiving notches may be present on the platform of the drum. Different varieties of snap-fit latches may be employed. Other possible alternatives will be recognizable to those skilled in this art.

In addition, those skilled in this art will appreciate that the device may be suitable for the singulated dispensing or other open-end closures. For example, the device could dispense and singulated lids for jars, bottles or cans, bowls, ashtrays, or the like.

The foregoing is illustrative of the present invention and is not to be construed as limiting thereof Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A device for singulating open-ended caps, the device comprising:

a housing configured to retain a plurality of open-ended caps, the housing having an open lower end;

an outer ring positioned below the housing;

a drum fixed to and positioned within the outer ring to form a drum assembly, the drum including a hub having a substantially circular wall and a platform that extends radially outwardly from the wall to contact the outer ring, the hub and outer ring forming a circular gap therebetween, the platform being positioned below much of the gap and including a discontinuity;

a mounting structure with an exit aperture fixed relative to the housing; and a rotary drive unit mounted to the drum that rotates the drum assembly about an axis of rotation;

wherein the outer ring includes first and second mating structures, the first mating structure being positioned on the outer ring above the second mating structure, wherein the first mating structure is positioned to mate with a mating structure of a drum having a platform located a first distance from the lowermost edge of the hub wall, and the second mating structure is positioned to mate with a mating structure of a drum having a platform located a second distance from the lowermost edge of the hub wall.

2. The device defined in claim 1, wherein the hub and platform are formed as a unitary member.

3. The device defined in claim 2, wherein the drum is formed of a polymeric material.

4. The device defined in claim 1, wherein the drum assembly is mounted such that the axis of rotation forms an angle of between about 40 and 50 degrees relative to horizontal.

5. The device defined in claim 1, wherein the mounting structure further comprises a pre-staging platform fixed relative to the housing and positioned such that rotation of the drum assembly about the axis of rotation positions the discontinuity above the pre-staging platform.

6. The device defined in claim 1, wherein the drum includes a generally cone-shaped section that is positioned above the wall of the hub.

7. The device defined in claim 1, wherein the platform of the drum contacts the first mating structure of the outer ring.

8. The device defined in claim 1, wherein the platform of the drum contacts the second mating structure of the outer ring.

9. The device defined in claim 1, wherein the drum assembly further includes an agitation slat that extends generally parallel with the wall of the hub.

10. The device defined in claim 1, wherein the drum assembly further comprises a ramp that slopes downwardly from an upper edge of the hub wall into the gap.

11. The device defined in claim 1, wherein the outer ring includes a radially inwardly-extending rim, the rim being sized so that an open-ended cap of a predetermined size is able to enter the gap if the open end of the cap is facing the hub, but is unable to enter the gap if the closed end of the cap is facing the hub.

12. The device defined in claim 1, wherein the hub includes a radially-extending vertical wall adjacent the discontinuity, the vertical wall positioned to convey a cap in the gap to the exit aperture.

* * * * *